US009856614B1

(12) United States Patent
Jiang et al.

(10) Patent No.: US 9,856,614 B1
(45) Date of Patent: Jan. 2, 2018

(54) ASEISMIC COMBINED PIER

(71) Applicants: Shenzhen Municipal Design & Research Institute Co., Ltd., Shenzhen (CN); SHENZHEN WISE-TECH Engineering Consulting Co., LTD., Shenzhen (CN)

(72) Inventors: Ruijuan Jiang, Shenzhen (CN); Xiachun Chen, Shenzhen (CN); Yiyan Chen, Shenzhen (CN); Weiming Gai, Shenzhen (CN); Jucan Dong, Shenzhen (CN); Qiming Wu, Shenzhen (CN); Tianhua Xu, Shenzhen (CN)

(73) Assignees: Shenzhen Municipal Design & Research Institute Co., Ltd., Shenzhen (CN); SHENZHEN WISE-TECH Engineering Consulting Co. LTD., Shenzhen (CN)

( * ) Notice: Subject to any disclaimer, the term of this patent is extended or adjusted under 35 U.S.C. 154(b) by 0 days.

(21) Appl. No.: 15/498,455

(22) Filed: Apr. 26, 2017

(30) Foreign Application Priority Data

Nov. 10, 2016 (CN) ..... 2016 1 0992278

(51) Int. Cl.
*E01D 19/02* (2006.01)
*E01D 19/12* (2006.01)

(52) U.S. Cl.
CPC ..... *E01D 19/02* (2013.01); *E01D 19/12* (2013.01)

(58) Field of Classification Search
CPC ..... E01D 19/02; E01D 19/125; E04B 2/56; E04B 1/08; E04B 1/32; E04C 2/32
See application file for complete search history.

(56) References Cited

U.S. PATENT DOCUMENTS 2,815,656 A * 12/1957 Klein ..... E01F 8/0023 52/169.1
3,820,295 A * 6/1974 Folley ..... E04B 1/08 52/270
4,099,359 A * 7/1978 Sivachenko ..... E01D 19/125 405/284
4,129,917 A * 12/1978 Sivachenko ..... E01D 2/04 14/6
4,186,541 A * 2/1980 Sivachenko ..... E01D 19/02 52/630
4,211,504 A * 7/1980 Sivachenko ..... E01D 19/125 405/124

(Continued)

*Primary Examiner* — Abigail A Risic
(74) *Attorney, Agent, or Firm* — Scheinberg & Associates, P.C.; Michael O. Scheinberg

(57) ABSTRACT

An aseismic composite pier includes one or more column limbs and waveform steel plates, wherein the adjacent column limbs are connected through a waveform steel plate to form a boxlike pier body. The wave direction of the waveform steel plate is along the longitudinal direction of the pier body. The column limbs sustain the longitudinal pressure and the bending moment, while the waveform steel plate sustain the horizontal shearing force. As a result, the flexural stability of the column limb, and the overall horizontal shearing resistance and the deformability of the pier are improved, and thus this kind of structure is suitable for piers with various heights; Moreover, the clear separation of the roles of the waveform steel plates and the column limbs improves the service efficiency of the materials.

9 Claims, 7 Drawing Sheets

(56) References Cited

U.S. PATENT DOCUMENTS

| | | | | | |
|---|---|---|---|---|---|
| 4,618,287 | A * | 10/1986 | Kinnan | E02D 3/08 | 405/216 |
| 5,586,417 | A * | 12/1996 | Henderson | E02D 27/42 | 405/233 |
| 5,826,387 | A * | 10/1998 | Henderson | E02D 27/42 | 405/249 |
| 5,833,394 | A * | 11/1998 | McCavour | E02D 29/045 | 405/126 |
| 6,524,722 | B2 * | 2/2003 | Schluter | F16L 9/06 | 428/603 |
| 6,672,023 | B2 * | 1/2004 | Henderson | E02D 27/42 | 405/244 |
| 7,618,217 | B2 * | 11/2009 | Henderson | E02D 27/12 | 405/239 |
| 7,824,598 | B1 * | 11/2010 | Kim | B28B 1/44 | 249/125 |
| 2007/0000077 | A1 * | 1/2007 | Wilson | E01D 19/125 | 14/73 |
| 2008/0019779 | A1 * | 1/2008 | Henderson | E02D 5/38 | 405/237 |
| 2008/0196341 | A1 * | 8/2008 | Kang | E01D 19/02 | 52/292 |
| 2011/0030298 | A1 * | 2/2011 | Paul | E02D 27/01 | 52/294 |
| 2014/0305066 | A1 * | 10/2014 | Wilson | E01F 5/005 | 52/643 |
| 2017/0030096 | A1 * | 2/2017 | Pantelides | H04W 16/26 | |

* cited by examiner

ASEISMIC COMBINED PIER

FIELD OF THE INVENTION

The present invention relates to the field of bridge buildings, and more particularly, to a steel-concrete composite pier structure with relatively good aseismic performance.

BACKGROUND OF THE INVENTION

Reinforced concrete piers are widely used in bridges at present. However, such kind of pier is very easy to be damaged under earthquake, which may lead to severe bridge accidents. Flexural failure and shear failure are two major damage types of reinforced concrete piers under earthquake. The flexural failure is caused by the insufficient flexural stiffness of the pier, and mainly happens in medium and high piers. The shear failure is caused by insufficient shear stiffness of the pier, and mainly happens in medium and low piers. Compared with the ductile flexural failure, the shear failure is a kind of brittle failure and may sometimes lead to more severe bridge accidents. Therefore, a high reinforcement ratio should be avoided for the medium and low reinforced concrete piers, and the shear stiffness of the reinforced concrete piers shall be guaranteed to be larger than the flexural stiffness.

Presently, in order to improve the aseismic performance of the pier, for rigid piers, the resistance to earthquakes is mainly improved by increasing the section area, increasing the reinforcement ratio, or using a reinforced-concrete composite structure, etc. For flexible piers, the shear bearing capacity and the shear deformation capacity thereof are mainly improved by optimizing the reinforcement ratio and the form of cross-section thereof. Since steel has a higher strength and a better ductility than concrete, some steel piers and concrete-filled steel tube composite piers are adopted in engineering. However, the cost these piers is relatively, bringing some limitations to the practical application.

SUMMARY OF THE INVENTION

To overcome the deficiencies of the prior art, the invention provides an aseismic composite pier.

The technical solutions used in the invention to solve the technical problem thereof are described as follows.

An aseismic combined pier includes one or more column limbs and a waveform steel plate, wherein the adjacent column limbs are connected through the waveform steel plate to form a boxlike pier body. The wave direction of the waveform steel plate is along the longitudinal direction of the pier body.

As a further improvement of the solution above, the column limb includes a reinforced concrete column, and the upper ends and the lower ends of column limbs are casted as an integrity, and the two sides of each waveform steel plate are embedded in the reinforced concrete column.

As a further improvement of the solution above, each of the two sides of the waveform steel plate is fixed to a vertical flange plate, and the flange plate is embedded in the reinforced concrete column.

As a further improvement of the solution above, a plurality of holes are drilled on the two sides of the waveform steel plate, and reinforcing bars in the reinforced concrete column are bound after being inserted through the holes.

As a further improvement of the solution above, the column limb includes a steel tube, and concrete is cast inside the steel tube, and the two sides of the waveform steel plate are welded to the steel tube to form an integrity.

As a further improvement of the solution above, a platform fixed to the bottom of the pier body is included.

As a further improvement of the solution above, at least two column limbs are set at two opposite sides of the section of the pier body, and the adjacent sides of the two column limbs are connected through the waveform steel plate, or four column limbs are set at the four corners of the section of the pier body.

As a further improvement of the solution above, the cross-section of the pier body can vary along the longitudinal direction.

As a further improvement of the solution above, the wave form of the waveform steel plate can be a trapezoid, a rectangle, a triangle or a circular arc.

As a further improvement of the solution above, the waveform steel plate is fabricated by pressing a plain steel sheet.

The invention has the following beneficial effects.

The longitudinal pressure and the bending moment are borne by the column limbs, and the horizontal shearing force is borne by the waveform steel plate. As a result, the flexural stability of the column limb, and the overall horizontal shearing resistance and the deformability of the pier are improved, and therefore this kind of structure is suitable for piers of various heights. The roles of the waveform steel plate and the column limbs are separated, which can improve the service efficiency of the materials. Meanwhile, the hollow pier body can reduce the concrete consumption and the self-weight of the structure, resulting in such advantages as convenient and quick construction, energy saving, environmental protection, and good economic efficiency.

Moreover, the other features and benefits of the invention are illustrated by reference to the exemplified embodiments.

BRIEF DESCRIPTION OF THE DRAWINGS

What is disclosed will be described in detail in this specification and illustrated in the accompanying drawings, wherein.

DETAILED DESCRIPTION OF THE EMBODIMENTS

All examples and conditional language recited herein are intended for pedagogical purposes to aid the reader in understanding the principles and the concepts contributed by the inventor to furthering the art, and are to be construed as being without limitation to such specifically recited examples and conditions. Within the scope of this application it is envisaged and intended that the various aspects, embodiments, examples, features and alternatives set out in the preceding paragraphs, in the claims and/or in the following description and drawings may be taken independently or in any combination thereof.

It should be illustrated that, unless otherwise specifically stated, when some feature is referred to as being "fixed on" and "connected to" another feature, it can be directly fixed on and connected to another feature, or indirectly fixed on or connected to another feature. Also, as used herein various directional and orientation terms such as "up", "down", "bottom", "top", "side", "front", "rear", "left", "right", and the like are used only as relative conventions and not as absolute orientations.

Furthermore, unless otherwise defined, all technical and scientific terms used in the text have the same meaning as commonly understood by those skilled in the art. The terms used in the description are only for the purpose of describing particular embodiments instead of limiting the invention. The term "and/or" should be interpreted as being inclusive of one or both items being joined thereby.

The invention provides an aseismic combined pier, which includes column limbs 100 and waveform steel plates 200. At least two column limbs 100 are served as the main load-bearing structure of the pier for taking the longitudinal pressure and the bending moment. The adjacent column limbs 100 are connected through the waveform steel plate 200 to form a boxlike pier body. The waveform steel plate 200 is a waved steel plate fabricated by pressing a steel sheet. The wave direction thereof is along the longitudinal direction of the pier body. The waveform steel plate 200 is used for sustaining the horizontal shearing force, and improving the flexural stability of the column limb, the overall horizontal shear resistance and the deformability of the pier. The roles of the waveform steel plates 200 and the column limbs 100 are clearly separately, which can improve the service efficiency of the materials. In addition, the pier body is hollow, which can reduce the concrete consumption and the self-weight of the structure, resulting in such advantages as more convenient and quicker construction and lower cost.

Preferably, the pier further includes a platform 300. It is a reinforced concrete structure set at the bottom of the pier body and used for supporting the pier body.

Figure 1:
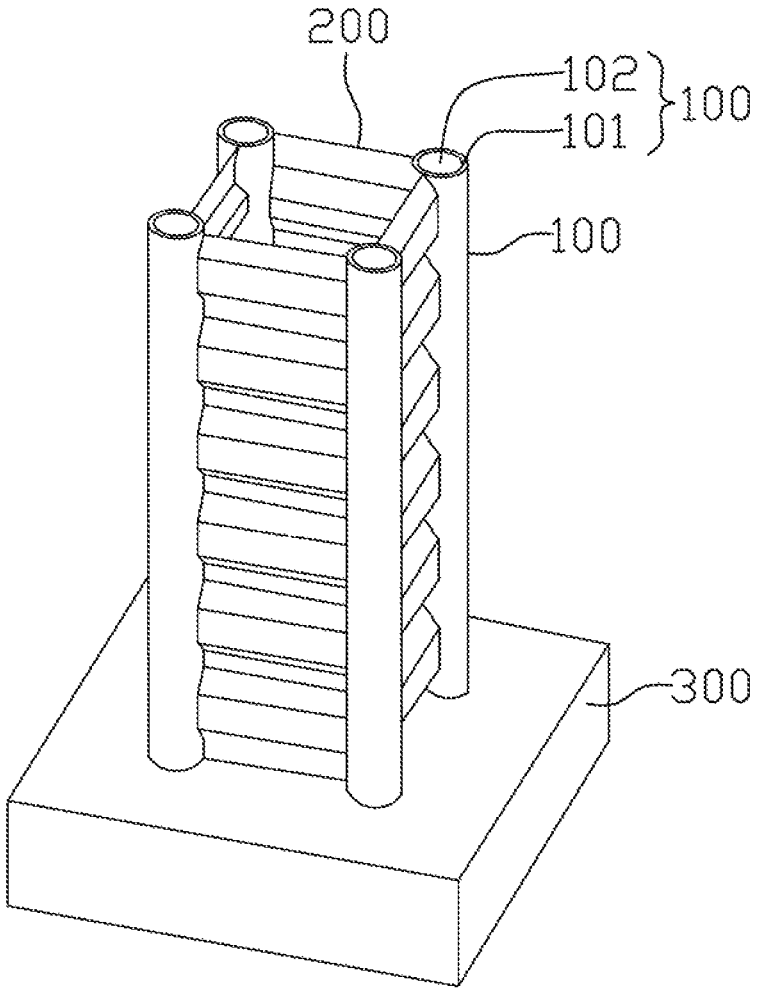
FIG. 1 is a three-dimensional schematic diagram of the first embodiment according to the invention.

FIG. 1 shows a three-dimensional schematic diagram of the first embodiment according to the invention. As shown in the figure, four column limbs 100 are included, wherein the column limbs 100 are located at four corners of a section of the pier body, respectively. The adjacent column limbs 100 are connected by the waveform steel plate. A column limb 100 in the embodiment includes a steel tube 101 and concrete 102 that is cast inside the steel tube 101 for increasing the strength of the column limb. The two sides of the waveform steel plate 200 and the steel tube 101 are welded to form an integrity, so as to fully fix the column limb 100 and the waveform steel plate 200.

The bottom of the steel tube 101 is connected to the platform 300.

Figure 2:
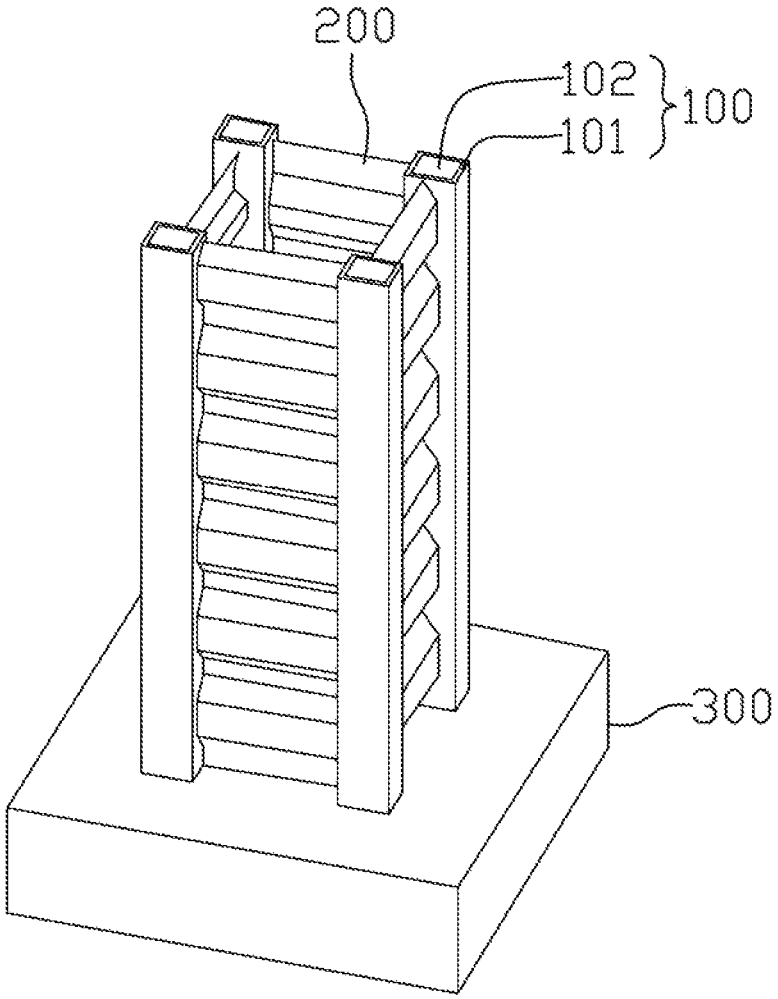
FIG. 2 is a three-dimensional schematic diagram of the second embodiment according to the invention.

FIG. 2 shows a three-dimensional schematic diagram of the second embodiment according to the invention, which has a similar structure with that of the first embodiment. The difference lies in that the steel tubes 101 in the first embodiment is are round tubes, while the steel tubes 101 in this embodiment are square ones.

The steel tube 101 may be prefabricated in factory, and is poured with concrete 102 and welded with the waveform steel plate on a construction site, which has the advantage of convenient and quick construction and saving construction time.

Figure 3:
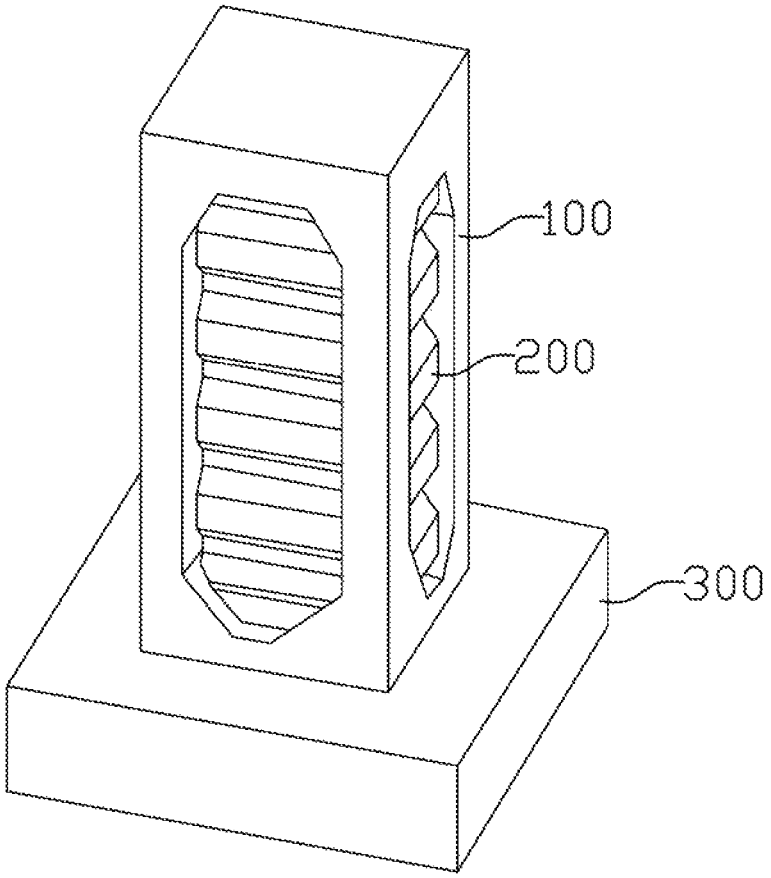
FIG. 3 is a three-dimensional schematic diagram of the third embodiment according to the invention.

Except for the concrete-filled steel tube column above, reinforced concrete columns can also be used as the column limbs of the invention. That is, the reinforced concrete structure is directly adopted to form the column limb. FIG. 3 shows a three-dimensional schematic diagram of the third embodiment according to the invention, wherein four column limbs 100 are set at four corners of the section of the pier body. The upper end and lower ends of four column limbs 100 are cast into an integrity. The waveform steel plate 200 is fixed between adjacent column limbs 100.

Figure 4:
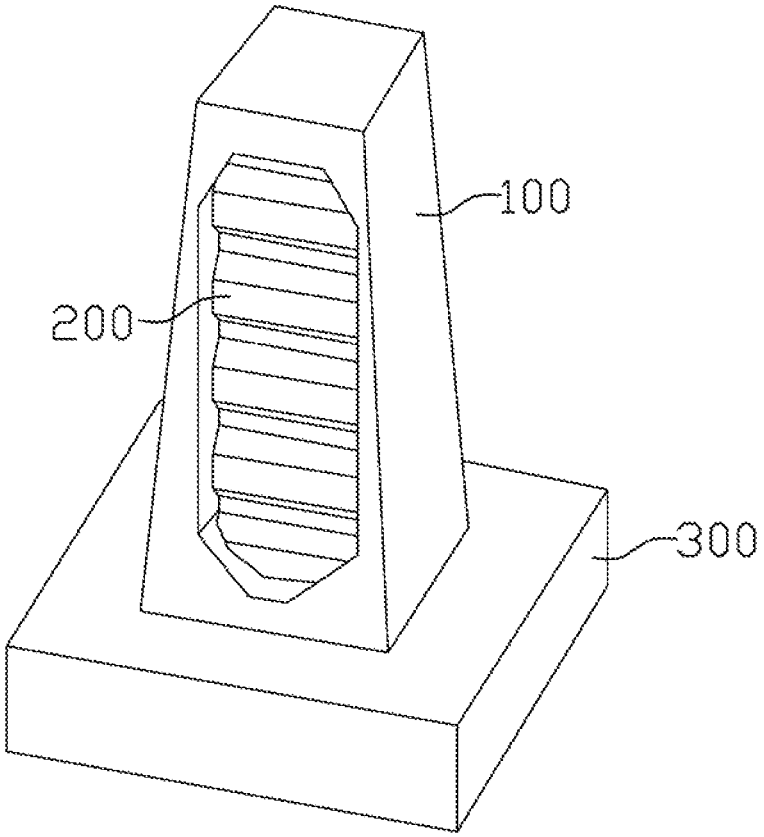
FIG. 4 is a three-dimensional schematic diagram of the forth embodiment according to the invention.

FIG. 4 shows a block diagram of the forth embodiment according to the present invention. In the embodiment, reinforced concrete column are also used as the column limbs, wherein the difference thereof lies in that only two column limbs 100 are set in this embodiment. The two column limbs 100 are reinforced concrete thin-walled column, and are located at two opposite sides of the section of the pier body. The adjacent sides of the two column limbs 100 are connected through the waveform steel plate 200.

The difference between the embodiment and other embodiments also lies in that the cross section of the pier body is varying. As shown in the figure, the area of the cross section of the pier body gradually increases from up to down.

In the embodiments above, the section of the column limb may be in various forms like a square, a rectangle, a trapezoid, a round, or the like. The technical parameters thereof like the section geometry, the thickness of the steel plate, the reinforcement ratio of the concrete can be adjusted according to the requirement of the bearing capacity.

Figure 5:
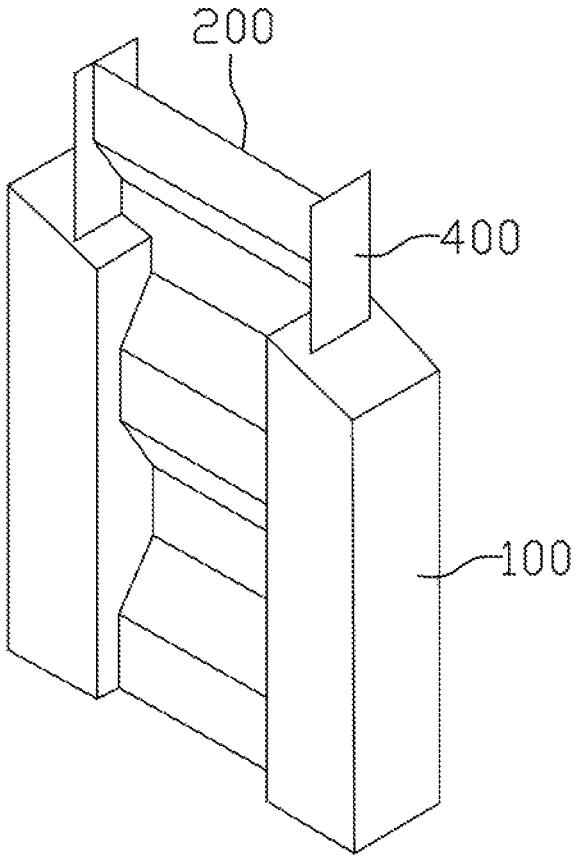
FIG. 5 is a three-dimensional schematic diagram of the first embodiment illustrating a waveform steel plate embedded in a reinforced concrete column.
Figure 6:
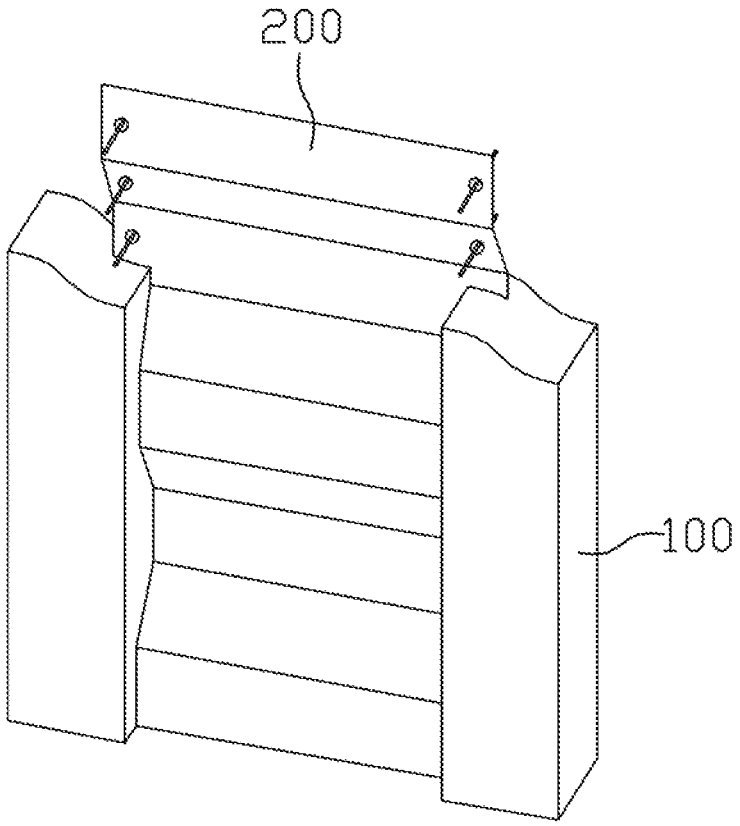
FIG. 6 is a three-dimensional schematic diagram of the second embodiment illustrating the waveform steel plate embedded in the reinforced concrete column.
Figure 7:
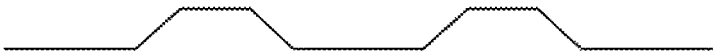
FIG. 7 is a side view of the waveform steel plate according to the invention in the first embodiment.
Figure 8:
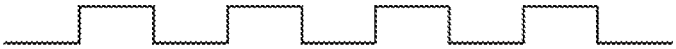
FIG. 8 is a side view of the waveform steel plate according to the invention in the second embodiment.
Figure 9:
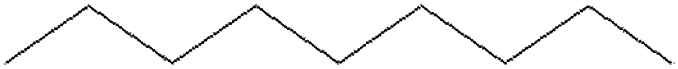
FIG. 9 is a side view of the waveform steel plate according to the invention in the third embodiment.
Figure 10:
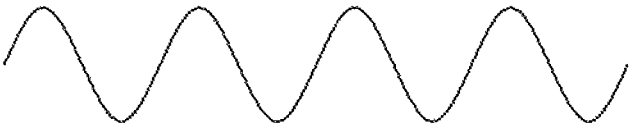
FIG. 10 is a side view of the waveform steel plate according to the invention in the forth embodiment.

For the column limbs formed by the reinforced concrete columns, the two sides of the waveform steel plate 200 are embedded in the reinforced concrete columns. To be specific, FIG. 5 and FIG. 6 show two embodiments where the waveform steel plate 200 is embedded in the reinforced concrete columns, respectively. With reference to FIG. 5, each of the two sides of the waveform steel plate is welded with a vertical flange plate 400, and then the flange plate 400 is embedded in the reinforced concrete column such that a reliable connection may be formed between the waveform steel plate 200 and the reinforced concrete column.

With reference to FIG. 6, a plurality of holes are drilled at the two sides of the waveform steel plate 200. When a reinforcing bar in the reinforced concrete column is set up, the reinforcing bar is inserted into the reserved hole and fixed through binding, and then a reliable connection is formed after pouring with the concrete. Certainly, the waveform steel plate 200 may also be connected to and fixed with the reinforced concrete column through other well known technology.

Various forms may be used as the waveform steel plate in the invention. FIG. 7 to FIG. 10 show side views of the waveform steel plate in each embodiment. As shown in the figures, the wave form of the waveform steel plate can be a trapezoid, a rectangle, a triangle, or a circular arc.

While this invention has been particularly shown and described with references to preferred embodiments thereof, it will be understood by those skilled in the art that various changes in form and details may be made therein without departing from the scope of the invention encompassed by the appended claims.

The invention claimed is:

1. An aseismic composite pier, comprising one or more column limbs and waveform steel plates, wherein the adjacent column limbs are connected through a waveform steel plate to form a boxlike pier body, and the wave direction of the waveform steel plate is along the longitudinal direction of the pier body, wherein the column limbs comprises a reinforced concrete column, and wherein the upper end and lower ends of column limbs are cast into an integrity with the two sides of the waveform steel plate embedded in the reinforced concrete column.

2. The aseismic combined pier according to claim 1, wherein the two sides of the waveform steel plate are fixed to a vertical flange plate, respectively, and the flange plate is embedded in the reinforced concrete column.

3. The aseismic composite pier according to claim 1, wherein a plurality of holes are drilled at the two sides of the waveform steel plate, and reinforcing bars in the reinforced concrete column are bound after being inserted through the holes.

4. An aseismic composite pier, comprising one or more column limbs and waveform steel plates, wherein the adjacent column limbs are connected through a waveform steel plate to form a boxlike pier body, and the wave direction of the waveform steel plate is along the longitudinal direction of the pier body, wherein the column limb comprises a steel tube poured with concrete, and wherein the two sides of the waveform steel plate and the steel tube are welded integrally.

5. The aseismic composite pier according to claim 1, further comprising a platform fixed to the bottom of the pier body.

6. The aseismic composite pier according to claim 1, wherein at least two column limbs are arranged at two opposite sides of the section of the pier body, and wherein the adjacent sides of the two column limbs are connected through a waveform steel plate, or four column limbs are arranged at four corners of the section of the pier body.

7. The aseismic composite pier according to claim 1, wherein the cross-section of the pier body is varying along the longitudinal direction.

8. The aseismic composite pier according to claim 1, wherein the waveform steel plate is shaped with a wave form including a trapezoid, a rectangle, a triangle or a circular arc.

9. The aseismic composite pier according to claim 1, wherein the waveform steel plate is fabricated by pressing a plain steel sheet.

* * * * *